US007497395B2

(12) United States Patent
Nordell

(10) Patent No.: US 7,497,395 B2
(45) Date of Patent: Mar. 3, 2009

(54) ROCK GRINDING MILL AND METHOD

(75) Inventor: Lawrence K. Nordell, 1469 Island View Dr., Bellingham, WA (US) 98225

(73) Assignee: Lawrence K. Nordell, Bellingham, WA (US)

( * ) Notice: Subject to any disclaimer, the term of this patent is extended or adjusted under 35 U.S.C. 154(b) by 0 days.

(21) Appl. No.: 11/758,628

(22) Filed: Jun. 5, 2007

(65) Prior Publication Data

US 2007/0284464 A1 Dec. 13, 2007

Related U.S. Application Data

(60) Provisional application No. 60/804,158, filed on Jun. 7, 2006.

(51) Int. Cl.
*B02C 17/14* (2006.01)

(52) U.S. Cl. ..... 241/183; 241/299; 241/284

(58) Field of Classification Search ..... 241/183, 241/299, 284, DIG. 30
See application file for complete search history.

(56) References Cited

U.S. PATENT DOCUMENTS

| | | | | |
|---|---|---|---|---|
| 987,850 | A | | 3/1911 | Braddock |
| 1,539,237 | A | | 5/1925 | Borcherdt |
| 1,741,604 | A | | 12/1929 | Barratt |
| 2,189,711 | A | | 2/1940 | Elgenbrot |
| 3,078,049 | A | | 2/1963 | Hardinge |
| 3,206,128 | A | | 9/1965 | MacPherson et al. |
| 3,404,846 | A | | 10/1968 | MacPherson et al. |
| 3,580,520 | A | * | 5/1971 | Myers ..... 241/299 |
| 3,865,541 | A | | 2/1975 | Wilson et al. |
| 4,136,832 | A | | 1/1979 | Morita et al. |
| 4,176,799 | A | | 12/1979 | Clin et al. |
| 4,194,710 | A | | 3/1980 | Ebner |
| 4,200,242 | A | | 4/1980 | Ueda |
| 4,211,369 | A | | 7/1980 | Eigner |
| 4,243,182 | A | * | 1/1981 | Dugger, Jr. ..... 241/153 |
| 4,289,279 | A | | 9/1981 | Brandt |
| 4,373,675 | A | | 2/1983 | Kaufman |
| 4,389,020 | A | | 6/1983 | Clin et al. |
| 4,424,938 | A | * | 1/1984 | Day ..... 241/182 |
| 4,580,734 | A | * | 4/1986 | Eroskey et al. ..... 241/182 |
| 4,635,860 | A | | 1/1987 | Kruyer |
| 5,752,665 | A | * | 5/1998 | Wason ..... 241/299 |
| 6,206,310 | B1 | * | 3/2001 | Schneider ..... 241/299 |

* cited by examiner

*Primary Examiner*—Bena Miller
(74) *Attorney, Agent, or Firm*—Robert B. Hughes; Hughes Law Firm, PLLC

(57) ABSTRACT

A grinding machine having plurality of lift elements positioned within the rotating drum. The lift elements are provided with a central ridge contact surface portion with slanted side surfaces extending from the ridge contact portion in a downward and outward configuration. Adjacent pairs of side surfaces form valleys with the downwardly converging side surfaces. In the grinding process, this enhances the effectiveness of the grinding mill.

20 Claims, 9 Drawing Sheets

ROCK GRINDING MILL AND METHOD

RELATED APPLICATIONS

This application claims priority benefit of U.S. Ser. No. 60/804,158, filed Jun. 7, 2006.

BACKGROUND OF THE INVENTION a) Field of the Invention

The present invention relates to rock grinding mills and more particularly to rock grinding mills into which rocks to be ground and water are directed, and the grinding mill section is rotated about a longitudinal center axis to cause the rocks to travel upwardly in a curved path to tumble back to impact other rocks to cause the rock to break up into smaller fragments.

b) Background Art

For many industrial purposes it is necessary to reduce the size of rather large rocks to a much smaller particle size (commonly called "comminution"). For example, the rocks may be blasted out of an area, and these larger rocks (sometimes the size of boulders) are then directed into a grinding mill. One common form of a grinding mill is where there is a large cylindrical grinding section which often could have a diameter of as much as ten to fifty feet. The rocks along with water or air is directed into one end of the continuously rotating grinding section, and there are various types of lifting ribs positioned on the inside surface of the grinding section to carry the rocks upwardly in a curved upwardly directed path within the grinding chamber so that these tumble back onto other rocks in the lower part of the chamber. Thus, these rocks impact each other and are broken up into smaller rock fragments. Also, sometimes large iron balls (e.g., two to six inches in diameter) are placed in the grinding chamber to obtain improved results.

It takes a tremendous amount of power to operate these grinding mills, and also there are other substantial costs involved. There are a number of factors which relate to the effectiveness and the economy of the operation, and the embodiment of the present invention is directed toward improvements in such mills and the method employed.

DESCRIPTION OF THE PREFERRED EMBODIMENTS

It is believed that a clearer understanding of the embodiments of the present invention will be obtained by first describing in general terms the overall apparatus of the first embodiment of the present invention, followed by a general description of the grinding process accomplished by the apparatus. That will be followed by a more detailed description of components of this embodiment and of second and third embodiments.

Figure 1:
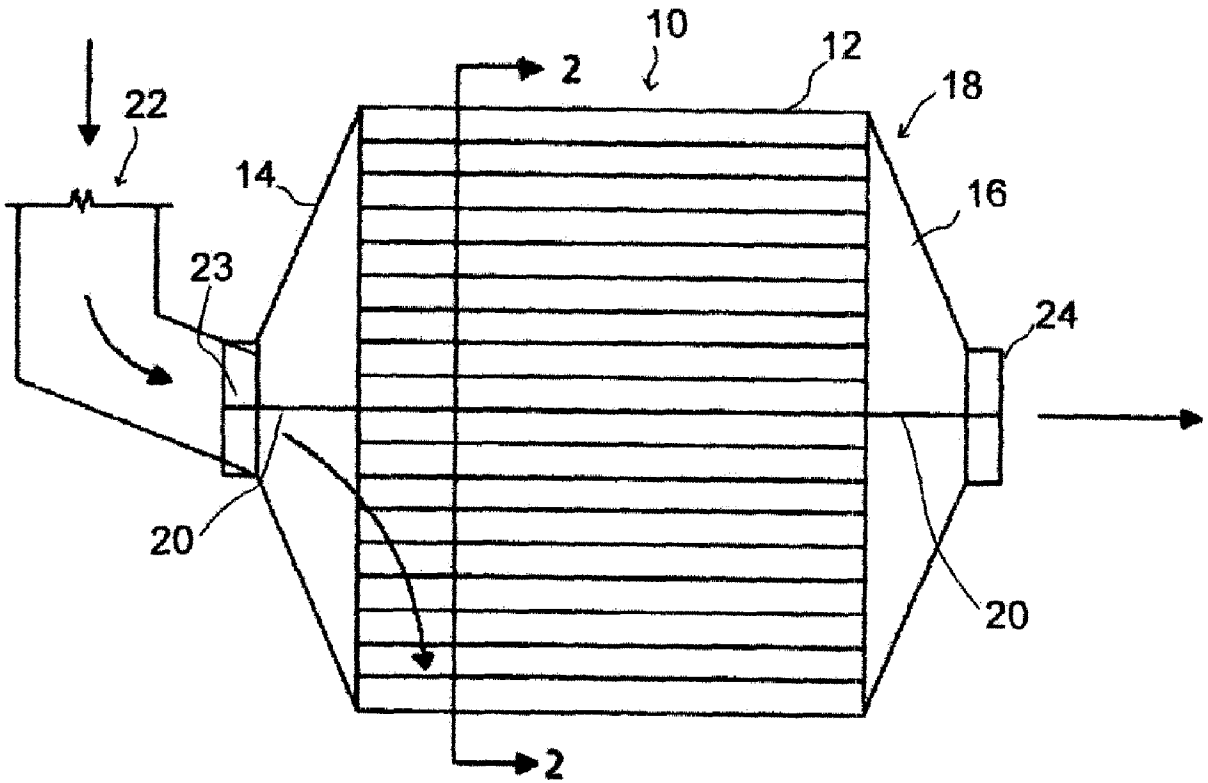
FIG. 1 is a side elevational view of a grinding mill an embodiment of the present invention.
Figure 2:
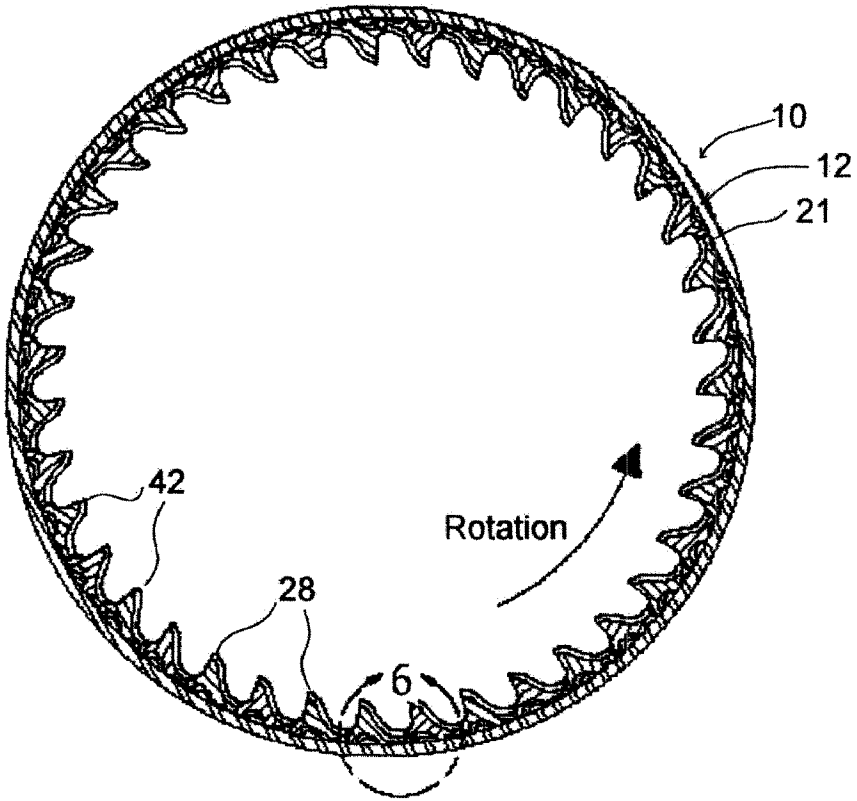
FIG. 2 is a cross-sectional view taken along line 2-2 of FIG. 1, showing the interior structure of the cylindrical grinding section of the mill.

To provide the initial description of the grinding mill 10 of this embodiment of the present invention, reference is first made to FIGS. 1 and 2. In FIG. 1, the grinding mill 10 is shown somewhat schematically in a side elevational view. This grinding mill 10 comprises a middle cylindrically shaped grinding section 12, a front rock and water intake section 14, a rear discharge section 16, and a longitudinal axis of rotation at 17 of FIG. 1.

The front intake section 14 and the rear discharge section 16 each have an overall frusto-conical configuration, with the circumferential rim of each base of the frusto-conical sections 14 and 16 joining to the front and rear circumferential edge portions, respectively, of the cylindrically shaped grinding section 12. These three sections 12, 14, and 16 are fixedly connected to one another to form a substantially unitary structure which is given the general designation 18. In the operation of the grinding mill 10, this entire structure 18 (made up of sections 12, 14, and 16) rotates about a longitudinal center axis 20 of the grinding mill 10, as will be described later herein. This rotation causes a continuous tumbling of the rocks to accomplish the grinding down of the larger rocks into smaller particles.

To introduce the larger rocks to be ground (along with water or air), into the rock and water intake section 14, there is provided a stationary rock and water (or air) feed section 22 which directs the larger rock with the water into a front center opening 23 of the front intake section 14. Then the rocks and the water or air are caused to move into the middle grinding section 12 to be subjected to the grinding process.

In the middle grinding section 12, the rock material is broken down into smaller particles, and these smaller particles eventually are carried away from the middle grinding section 12 into the rear discharge section 16 and discharged through a center discharge opening 24 in the rear discharge section 16. Then the mix of smaller rock particles is carried from the grinding mill to another location for further handling and/or treatment in accordance with conventional industrial procedures.

As indicated earlier, in the operation of the grinding mill 10, this entire unitary structure 18 rotates about this longitudinal axis 20 to cause the tumbling action of the rocks to break down the rocks.

Figure 7:
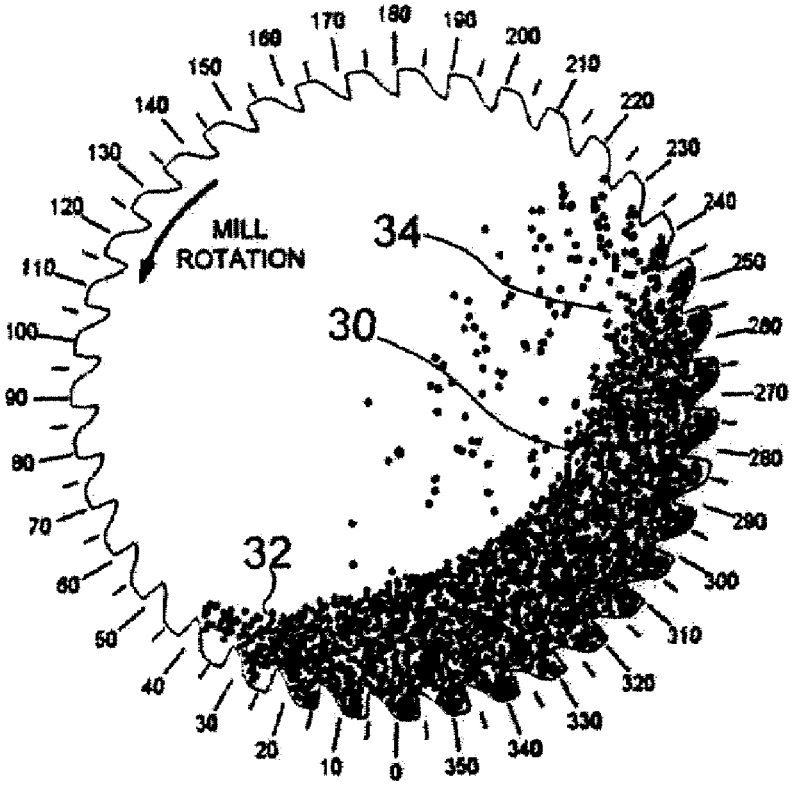
FIG. 7 is a schematic view of the grinding mill interior showing the position of the tumbling rock material during operation of the mill.

To describe in general terms how the larger rocks are broken down by this tumbling action into smaller rocks and rock particles in the grinding section 12, reference is now made to FIG. 2 and also to FIG. 7. The middle cylindrically shaped grinding section 12 would normally be made with an outer cylindrical structure 21 (which is sometimes called the "mill shell" 21) with a cylindrical liner positioned within that shell, thus giving the grinding section 12 sufficient structural strength. Then on substantially the entire inside cylindrical surface of the liner of the cylindrical grinding section 12 there is a lift section 26 which is made up of a plurality of lift elements (lifters 28). These lifters or lift elements 28 are positioned on the inside cylindrical surface of the cylindrical middle grinding section 12 throughout substantially the entire inner surface.

To accomplish the grinding of the rocks into smaller particles, the entire structure 18 is rotated about the longitudinal axis 20 in a counter-clockwise direction upwardly along the right side of the shell 21. The mass of rock shown in FIG. 7 is called the "charge" 30, the lower left end portion of the charge 30 is called the "toe" 32 of the charge 30 and the upper right hand end portion of the charge 30 and is called the "shoulder" 34 of the charge 30. The toe 32 of the charge 30 is the point of entry into the charge 30, and the location of the shoulder 34 is the region of exit from the charge 30 (this being shown at about the 240° location). To discuss further how this results in the grinding of the larger rock pieces, reference is now made FIG. 7.

As can be seen in FIG. 7, the middle grinding section 12 is rotating counter-clockwise, and the pieces of rock are carried with the interior wall of the middle section 12 from the lower toe location 32 in an upwardly curved path of travel along the right side in something of a "kidney bean configuration". At a higher level the rocks begin tumbling and/or sliding downwardly away from the shell 21 in the opposite direction of the shell rotation creating a cyclonic motion. This results in a great variety of impacts and sheer action which break down the rock material into yet smaller particles. Further, quite often iron balls are distributed or positioned in the grinding chamber defined by the middle grinding section 12. These iron balls impact the rock particles to add additional impacts that break down the particles and increases the charge density which increases intensity of sheer forces in the region of the toe 32.

At this time, there will be no attempt to give any detailed explanation or analysis of the many ways in which these forces occur, but a few general comments are believed to be in order.

There are a number of factors to be considered in discussing the path and force of gravity on these rocks and rock particles, and it should be mentioned that in addition to the force of gravity, it is necessary to consider also the momentum of the various rock particles as they move upwardly and to the right. Also, there is the centrifugal force that occurs since these rock pieces or particles are traveling a circular path.

In some of the larger grinding mills, the grinding sections 12 can be as great as forty or fifty feet in diameter, with these being rotated at a speed of possibly nine or ten revolutions per minute. This would translate into a linear speed at the circumference of possibly eighteen to twenty feet per second. Further, as indicated above, in many instances iron balls that could be five or six inches in diameter are located in the grinding chamber. The spherical configuration of these iron balls would obviously have the effect of contributing substantially to the impact and sheer forces in the grinding process. Also, they will affect the "kidney bean" sloped configuration of the rock particles and fragments that travel up the slope of the inner surface of the grinding section 12.

With reference now to FIG. 7, it can first be observed that there are a number of free falling particles, these being indicated generally by the numeral 30. These are the rocks, iron balls and rock particles that are carried to a further upward location where they move free from the lift elements 28 to be projected somewhat laterally and downwardly to a lower toe location. Depending upon various factors, in the prior art these may land on other rock fragments or may also be propelled far enough so that they would directly impact the bare interior surface to impact the lift elements directly.

Then there are the upper portions of the rocks and rock particles that are carried upwardly (e.g., from the toe location over a 160° path to the shoulder region 34) up the side of the inside surface of the grinding section 12. These would be more prone to tumble downwardly to a lower level approaching the toe 32, causing sheer and impacts with other particles. Then this would, of course, expose other rocks and rock particles which are a short distance behind those which have just tumbled away and rapidly rising, and these newly exposed rocks are rapidly arising, so that these start their downward path of tumbling to a lower region.

In addition, there is the dynamics of the rocks and rock particles which are located in the greater middle mass of rocks and rock particles that are being carried at deeper levels near the inside surface of the grinding section 12. As these are carried rapidly toward a higher location, the downward movement of some of these would be impeded by the lifters 28, there would therefore be sheer forces at the layers of rocks which are further away from the influence of the lifters 28. This could cause internal sliding or tumbling of a section of the rocks and rock particles.

It should be understood that the above comments are more in the nature of general observations as to some of the factors which result in a variety of impacts that influence the grinding process.

Let us turn our attention now to the individual lift elements 28, and reference will first be made to FIGS. 3-6. In describing these lift elements, the terms "forward" and "rear" are related to the direction of travel of that particular lift element 28. The element 28 is considered as traveling in a forward direction, which would indicate that a forward portion of the lift element 28 would be that portion which would reach any given point before the rear part.

Also, in discussing configuration of lift elements 28, the terms "up" and "down" do not refer to the direction of the earth's gravity. Rather, the term "up" as it applies to any one location of a lift element 28 is considered to be a direction from the circumference location of the grinding section 12 where the lift element is located directly to the center of rotation at the longitudinal center axis 20. Thus, in the context of the paragraph immediately above, the term "downwardly" or "down" shall indicate a direction which is radially aligned and extending away from the center of rotation at the longitudinal axis 20 toward the mill shell 21 or outer circumference.

However, when the discussion relates to the movement of the rocks from the lower part of the revolving grinding section 12 toward the upper part, the terms "up" and "down" refer to movement or position relative to the law of gravity. Thus, in discussing the relative locations and directions of the lift elements 28 of FIG. 6, the term "upward" indicates a direction toward the longitudinal axis 17. However, in discussing the lifting of the charge 30 of rocks, as in FIG. 7, the term "upward" means a direction of lifting relative to the force of gravity.

Also, in describing angular relationships, an angle of any particular line shall be relative to a radius line at the location where the angular measurement is being taken or to a line perpendicular to that radius line.

The lift elements 28 are arranged in circularly extending rows 42 located one next to the other, relative to the position along the longitudinal axis, with each row being located in a plane perpendicular to the longitudinal axis 17 and extend substantially across the entire inner surface of the middle grinding section 12. The lift elements 28 in each row 42 could be formed as one or more unitary structures.

Figure 6:
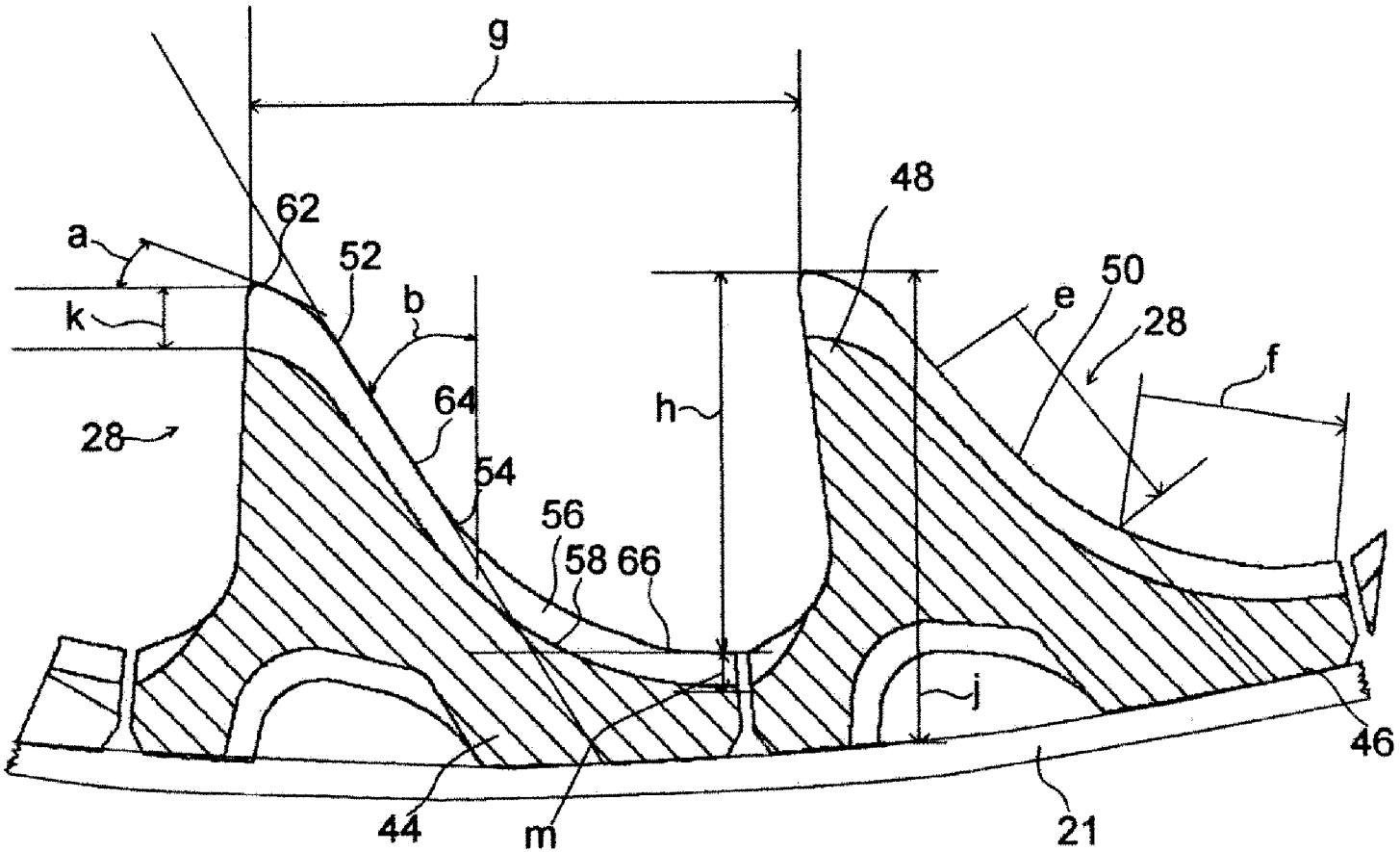
FIG. 6 is a sectional view of two lift elements positioned one in front of the other, with the sectional view taken down along a plane extending through the valley portions of these two lift elements taken from FIG. 2.

To discuss the configuration of these lift elements 28 in more detail, reference is first made to FIG. 6 which shows two of these lift elements 28 in cross-section, one in front of the other. Each lift element 28 comprises a base 44 which extends substantially the entire length of the lift element 28 and is adjacent to the liner or shell 21 of the middle grinding section 12. Each lift element 28 also has a front toe portion 46, an upper back portion 48 and a middle surface portion 50.

Each lift element 28 has a curving upwardly and forwardly facing contact surface 52 which is made up of a middle ridge surface 54 and two sloping side surfaces 56, which can be termed as valley surfaces. Also, with the lift elements 28 arranged adjacent to one another in rows, each pair of two adjacent valley surfaces 56 (i.e., side contact surface portions) from two adjacent lift elements 28 comprise a valley 58.

To discuss more specifically the configuration of the lift elements 28, reference is made to FIG. 6 which is a sectional view, with the plane of the sectional cut being taken on a plane that lies in a vertical radius line at that location and also that lies in a forward to rear direction. The specific location of the section plane is coincident with the two valleys 58 that are in line with one another.

With further reference to FIG. 6, the contact surface 52 can be considered as having three main surface sections. First, there is an upper rear surface portion 62 which has its ridge surface portion more horizontally aligned, and as shown herein is at about 20° downward and forward slope relative to a horizontal base line. However, while the 20° slope has been demonstrated to be satisfactory, within the broader scope of the invention this slope could be decreased to by one degree increments (e.g., 17°, 16°, 15°, etc. down to zero degrees) to being totally horizontal. Also, within the broader scope of the invention this slope could be increased by one degree increments up to possibly as high as 30° or 40°.

Then there is the intermediate downward and forward sloping contact surface portion 64, and in the arrangement of FIG. 6, this is shown as having an angle "b" "relative to the vertical of approximately 35°. Within the broader scope, this slope could be decreased or increased by one degree increments (i.e., 34°, 33°, 32°, . . . etc.) so that the angle "b" could be lowered to possibly 15° or even as low as 5° or lower. Under some circumstances, the angle "b" could be increased by one degree increments up to 20° or 10°.

Then there is the forward curved upwardly facing ridge contact surface portion 66, and this extends from the intermediate section 64 in a curve which gradually flattens out, until at the most forward portion, it may be substantially horizontal or angled to the horizontal up to 10° or 20° by one percent increments (i.e., 1°, 2°, 3°, . . . etc.).

With further reference to FIG. 6, the approximate length of the intermediate sloping section 64 is indicated at "e", while the length of the forward curved upwardly facing section 66 is indicated at "f". The drawing of the two elements in FIG. 6 are drawn to scale as to relative dimensions, and as indicated above, while this configuration shown in FIG. 6 has turned out to be quite satisfactory for certain situations depending upon a variety of factors, these could be changed.

In FIG. 6, there is the dimension "g" which is the forward to rear top spacing distance of any two adjacent rows of lift elements 28 in a forward to rear spacing. The dimension "h" is the vertical distance from the very top end of the upper rear surface portion 62 to the lowest elevation of the forward upwardly facing section 66 (commonly referred to as "height above the plate"). The dimension "j" is the total height of each of the lift elements 28 (also called "height above the mill shell").

To put these dimensions in perspective with respect to the overall size of the grinding mill, this particular design is made for a grinding section 12 having a forty foot diameter. For a grinding mill of this size (i.e., a twenty foot inside radius) the dimension "j" as shown in FIG. 6 is about two and one half feet, which is about 12.5% of 100% for the twenty foot radius. The size of the lift elements 28 will to some extent be proportional to the overall dimensions of the grinding mill, so for a smaller mill (e.g., one that is twenty feet or ten feet in diameter), the lift elements 28 shown in FIG. 6 would be reduced in size by about one half or three quarters.

To put these dimensions relative to one another, the dimension "j" of FIG. 6 is considered to be a 100% value, and the other dimensions of "e", "f", "g", "h", and "k" are given a percentage of value equal to size of that dimension divided by the dimension "j". It turns out that these dimensions are as follows: dimension "e"=50%, dimension "f"=45%, dimension "g"=112%, dimension "h"=80%.

There is also the depth dimension of the valley 58 of adjacent lift elements 28, being formed from the ridge surface 54 down to the valley line 58. The depth of this valley 58 that is formed at the upper rear end of the lift element 28 is indicated at "k", and the depth of this valley at the very most forward end is indicated at "m". The percentage values of these are as follows: "k"=11%, and the dimension "m" is 5.5%.

As indicated above, by way of example the grinding section 12 was indicated as having a forty foot diameter, so that there is a twenty foot radius. It was also indicated that the total height "j" of the lift elements 28 is about two and one half feet which is about 12½% of the twenty foot radius. It is quite common in the grinding mill art to relate the various dimensions of the lift elements to the radius of the grinding section. Therefore, if we are to relate these various percentage dimensions "e", "f", "g", "h" and "k" as they exist where there is the twenty foot radius, their percentage values of length dimensions would be multiplied by 2.5 feet to determine the actual length in terms of feet. Thus, by way of example, the dimension "h" of 80% would be calculated by multiplying 80% (i.e., 0.80) by 2.5 to get a value of 2.0 feet. Also, the dimension "e" which has a 50% value would be 1.25 feet.

Thus, within this broader scope of the embodiments of the present invention, these relative dimensions could be increased or decreased relative to the radius or relative to each other depending upon the situation and a number of related factors. Thus, any one of these dimensions (or a combination of several inventions) relative to the grinding mill radius or to each other could be increased or decreased by five percent increments of the dimension or angular values ranging from 50% on the low side and 200% on the high side.

Figures 3, 4, 5:
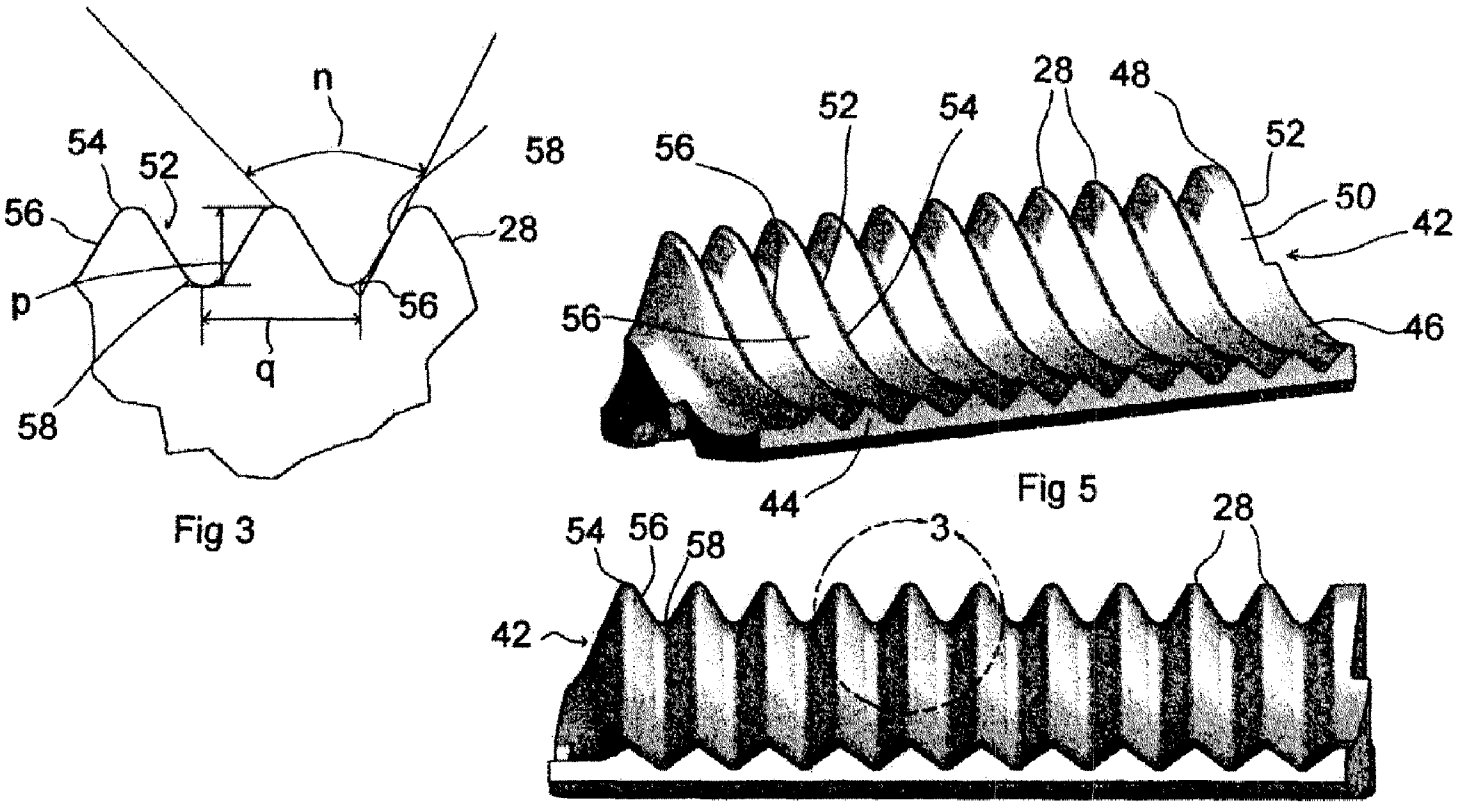
FIG. 3 is a cross-sectional view taken across three lift elements of the present invention, these being taken at a circle indicated at 3 in FIG. 4.
FIG. 4 is a front elevational view showing a row of lift elements of the embodiment of the present invention.
FIG. 5 is an isometric view similar to FIG. 4, but taken from a vantage point shifted to the left and elevated.

Let us now turn our attention to FIG. 3 which shows in cross section the contact surface 52 which is made up of the ridge surfaces 54, the slope surfaces 56, and the valley surfaces 58 which extend from the ridge surface 54 down to the lower valley surfaces 58. Each pair of adjacent surfaces 56 that meet at a lower valley surface 58 have a slope angle "n". In this particular embodiment this slope angle "n" is about 65°. It is possible that this could be raised or lowered to accomplish somewhat different functions in the comminuting and wear process, and the slopes do not necessarily have to be uniform. For example, they could be more narrow or steeper at a location at one level and different at a lower or higher level. This could have an influence as to what direction the material being milled is to migrate. The height dimension "p" of the ridges in FIG. 3 is approximately one half the lateral spacing dimension "q" between two valley surface portions 54.

It is to be understood that 65% slope angle "n" could be modified to be greater or smaller, and the size of the angle could possibly be changed sufficiently high so as to be doubled, or possibly greater, or at various intermediate values in one degree increments to increase or decrease that angle. Also, the various dimensions could also be varied in the manner as discussed earlier herein relative to the dimensions "e", "f", etc., as described earlier in this text.

To discuss now the operation of the present invention, the basic method of rotating the grinding section already used in the prior art is employed. If the grinding mill is a rather large mill (e.g., having a forty foot diameter grinding section), these lift elements 28 could be two and one half feet in height. As discussed earlier, it is inherent in the milling operation that the various rocks and smaller rock particles travel a course up the side of the interior surface of the mill section 12 and then descend downwardly to a lower portion of the grinding chamber.

These rocks and rock fragments that tumble from the upper side level downwardly mix with other rocks and cause these and/or themselves to chip and fracture. As these rocks and rock fragments are tumbled repeatedly the fragments come to a smaller and smaller size, and then these are discharged in a manner that is conventional in the art from the discharge section 16 of the grinding mill 12.

It should be noted that this embodiment of the present invention has the lift elements 28 contoured so that a very substantial portion of the surface area of these lift elements 28 are slanted from the horizontal. Thus, the rocks and possibly the iron balls used in the milling method that impact the surfaces of the lift elements make less of a direct hit but more of a glancing blow.

Also, there is a wedging effect of the sloping side surfaces 56 of adjacent pairs of lift elements 28, and rocks and rock fragments become positioned so there is a wedge action against the two side surfaces 56, so as to be capable of introducing some sheer forces which otherwise would likely not be present. When the wedged rocks are impacted, the impact loads are transmitted into those side surfaces, thus presenting an amplified fracturing or chipping force that would not otherwise be there if it was simply a head-on impact of the rock on a flat non-wedge configuration which reduces the degrees of freedom as to where the rocks can move during impact.

Also, these valleys 58 with their slanted surfaces 56 that exist between the lift elements 28 also are able to have something of a channeling effect in directing the path of travel of the rocks and rock fragments. Thus, with the valleys 58 being aligned in a forward to rear direction (relative to rotation about the longitudinal axis 17), the movement of the rocks would at least to some extent be directed into an aligned valley 58.

Figure 8:
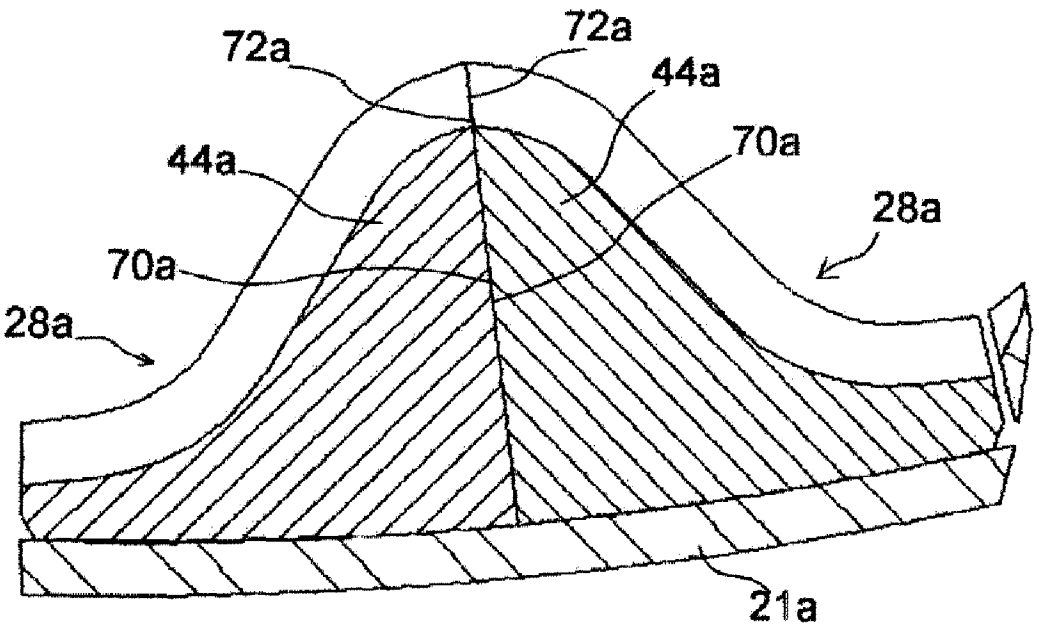
FIG. 8 is a sectional view similar to FIG. 6, showing a second embodiment of the present invention where each set of two rows of lift elements are in a different arrangement.

A second embodiment of the present invention is shown in FIG. 8. Components of this second embodiment which are the same as, or similar to, components of the first embodiment will be given like numerical designations, with an "a" distinguishing those of the second embodiment.

In this second embodiment, there are two lift elements 28*a* which in overall construction are substantially the same as the lift elements 28 of the first embodiment. However, in this second embodiment, these are arranged so that the grinding mill can operate by rotating in either a clockwise or counter-clockwise direction. This is accomplished by having two rows of lift elements 28*a* which are positioned adjacent to one another in back-to-back relationship. Thus, instead of being positioned as in FIG. 6, where all of the rows of the lift elements 28 are facing for forward movement in a counter-clockwise rotational movement, these are located back-to-back so that the row of lift elements which appears on the right side of FIG. 8 face in a counter-clockwise direction, while the other row of lifting elements 28*a* is directed to accomplish the functions of the grinding mill by traveling in the clockwise direction.

The two bases 44*a* of the two lift elements 28*a* have their back surfaces 70*a* aligned in a vertical plane, and these two surfaces 70*a* abut one another. Also, the rear faces 72*a* of each of the contact surface portions 52*a* are in alignment with one another.

In operation, if the grinding mill is to be rotated in the counter-clockwise direction, as in the first embodiment, then the tumbling action of the rock and rock fragment pieces go through the milling process as described in the description of the first operation embodiment. The left row of elements 28*a* is substantially removed from the comminuting process, except possibly for some of the rock or rock particles having moved over to those left elements 28*a*.

It is believed that the overall operation of this embodiment is evident from reviewing the text describing the operation of the first embodiment, so this will not be discussed further in these remarks.

Figure 9:
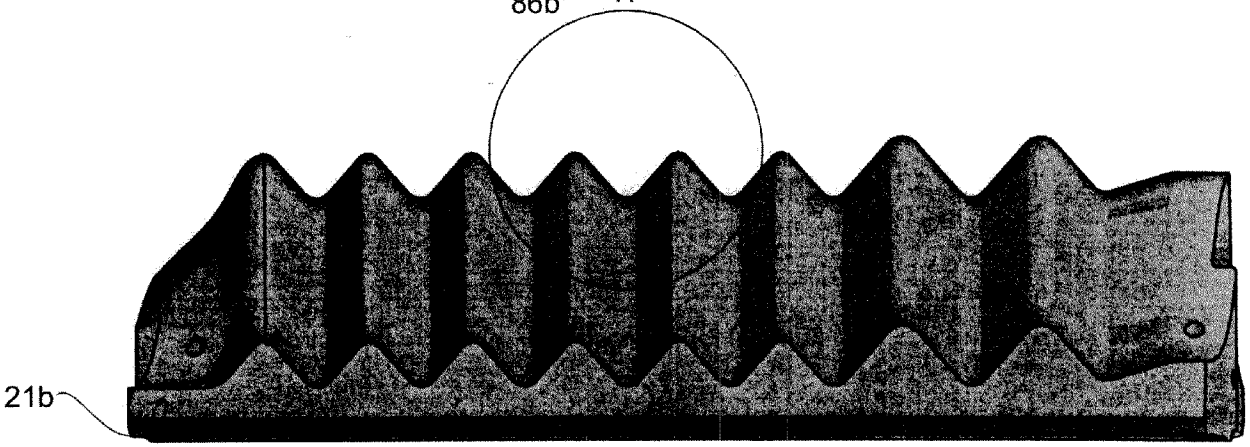
FIG. 9 is a view similar to FIGS. 6 and 8 and shows a yet a third embodiment of the present invention.

A third embodiment of the present invention will now be described with reference to FIGS. 9, 10 and 11. Components of this third embodiment which are the same as, or similar to, corresponding components in the first two embodiments will, in most part, be given like numerical designations with a "b" suffix distinguishing those of this third embodiment.

As in the first two embodiments, this third embodiment 80*b* comprises a plurality of lift elements 28*b*, with each lift element 28*b* having a base section 44*b* which is supported by the mill shell 21*b*.

The lift element 81*b* is substantially the same as, or similar to, the lift element 28*a* of the first embodiment with regard to its overall configuration, and design details which are disclosed in the description of the first embodiment.

Thus, in this third embodiment the contact surface 52*b* extends substantially across all of the said lift element 28*b* and comprises a middle-ridge contact surface 54*b* and sloping side surface portions 56*b*. Then there is a valley floor portion 58*b* where the side sections merge. Further, the lift element 28*b* has a back upper contact surface portion 62*b*. Then in like manner, there is the intermediate sloping contact surface portions 64*b* and the upwardly facing end contact surfaces 66*b*.

This third embodiment differs from the first embodiment primarily in the arrangement of the base section 44*b* of this third embodiment. In the first embodiment, the base section 44 is a unitary structure. In this third embodiment, the lift element 28*b* is formed as four separate members with one of these being a shared member that is located at the juncture location of two elements 28*b*. These are assembled with one another to form the single lift element 28*b* or a group of connected lift elements 28*b*. More specifically, there is a main central section 82*b*, which (as its name implies) is at the central part of the lift element 28*b*, two side sections 84*b* and a shared juncture section 86*b*. These four sections 82*b*, 84*b* and 86*b*, are removably joined together so as to function as a single unitary structure. However, there is a difference in that these can be separated from one another and reassembled for various purposes, such as providing replacement sections.

Also, this third embodiment differs from the prior two embodiments in that the structural materials used in forming the four sections 82*b*, 84*b* and 86*b* are not all made of the same structural material. More specifically, in this third embodiment, the main central section 82*b* and the shared section 86*b* are each unitary structures in themselves, that are made of a high strength rigid metallic material or other high strength material. This material would be (or could be) the same type of metal that is used in conventional grinding mills. Then the two intermediate sections 84*b* are each made of a softer or more yielding material.

Each lift element 28*b* comprises the three sections 82*b* and the two adjacent sections 84*b* that are between a pair of spaced juncture sections 86*b*. The upper surface of each main central section 82*b* comprises the entire middle ridge contact portion 54*b* and the major upper portion 88*b* of each of the sloping side surfaces 56*b*. The lowermost portion of the sloping surface portion 56*b*, indicated at 90*b* comprises the upper surface portion of each of the side sections 84*b*.

The adjacent side surfaces of all the sections 82*b*, 84, and 86*b* are vertical planar surfaces so that they can be properly joined one against the other to effectively form what amounts to a unitary lift element 28*b*. To join these sections together, each of the sections 82*b*, 84*b* and 86*b* are provided with through openings to receive bolts, with these three openings being indicated at 94*b* in FIG. 12. Also, the lift elements 28*b* are all fixedly joined (e.g., by bolts) to the shell 21.

Figure 10:
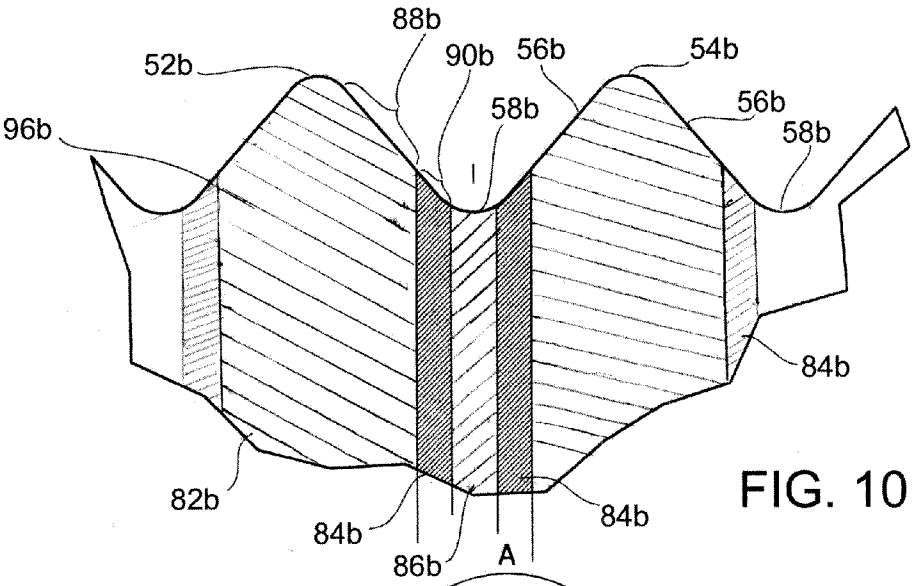
FIG. 10 is an elevational view taken of that portion of the drawing that is circled in FIG. 9, this showing the several sections of this third embodiments.
Figure 11:
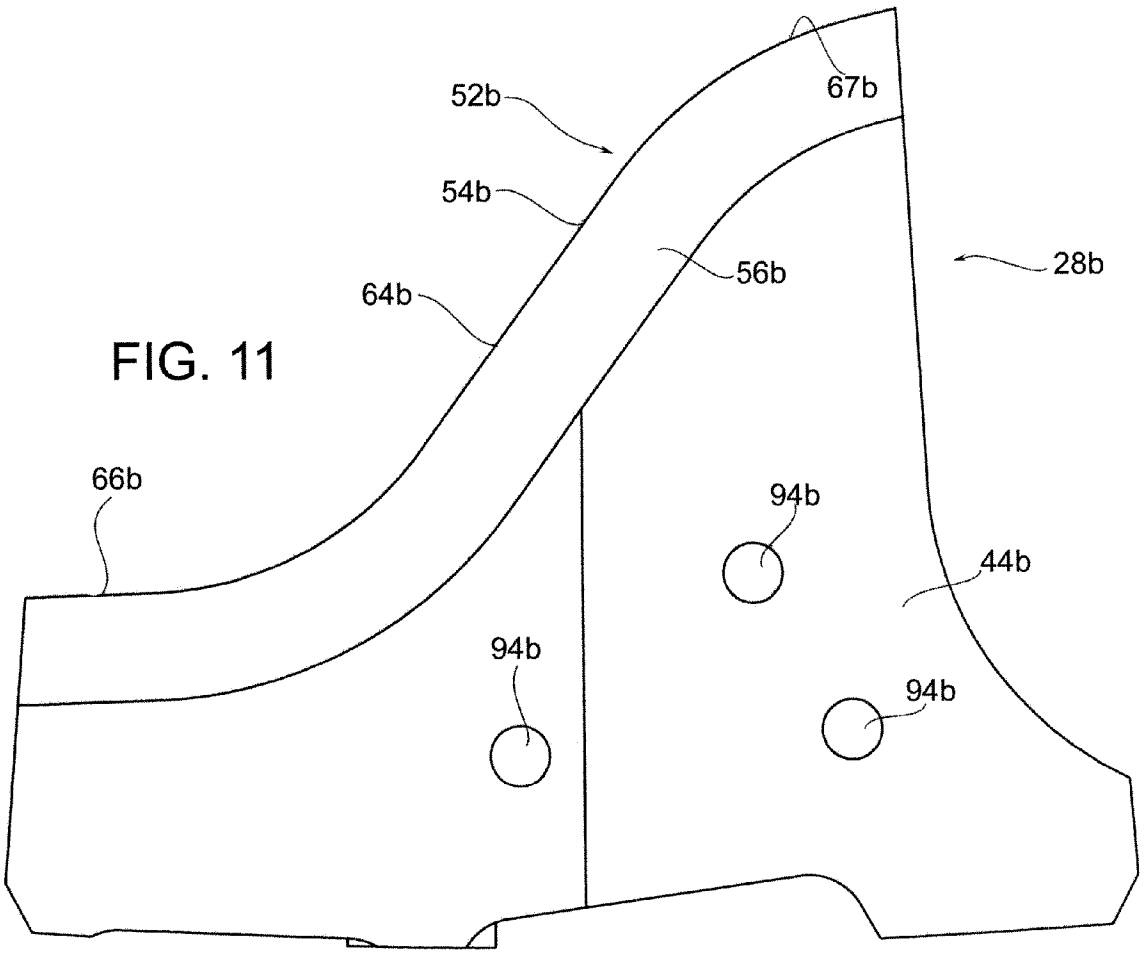
FIG. 11 is an end elevational view of the lift element of the third embodiment.

To discuss the operation of this second embodiment, reference will made to FIG. 10. During the operation of the grinding apparatus, the rocks and other fragments will contact the upwardly facing surfaces. It generally happens that the more prominent surface portions (i.e., those that are raised above the adjacent surfaces) will wear down more quickly from these impacts compared to the lower slanted portions. Thus, the uppermost ridge contact surface 54*b* will generally wear down more quickly than the sloping surfaces 56*b*.

As this wearing of the right contact surface 54*b* continues, at the same time, the rocks and debris will also be striking the exposed surface portion 90*b* of each of the side sections 84*b*. Since these portions 90 are made of a less durable material, it is expected that these will wear away at a more rapid rate than the surfaces of the main central portion 82*b*. Thus, each of the lower outside edges 96*b* of each main central member 82*b* will be more exposed and have little lateral support. Because of this, this edge corner section 96*b* would break off to some extent and wear away at a more rapid rate. This effect will also have the effect of exposing the surface section immediately above the break area to feel more stress and in a like manner it would begin breaking off. Now the overall effect of this is that the upper middle portion of each main central section 82*b* will overall maintain the original contour of having the middle peaked portion and the two valley side portions.

To analyze the effectiveness of the apparatus of the present invention a computer analysis was conducted relating to the performance of two grinding mills. The first grinding mill was a conventional grinding mill where there were lift elements, but without the configuration of the present invention. The second grinding mill was the same as the first grinding mill that was tested, but there was added the slanted sidewalls of the lift elements forming the valleys 58 of the present invention. In other respects, the designs of the two grinding mills were the same.

The method used is termed the "Discreet Element Method (DEM) Simulation Of The Mill". The parameters were chosen to mimic actual particle characteristics. These included the particle size distribution, density, spring constants, restitution, and cohesion/adhesion. Information of these valuables is readily obtained from available sources, and this information along with information from routinely analyzed ore samples were inferred. The values chosen for this particular simulation are typical of copper oar during the milling process. Several hundred thousand particles were used for these simulations.

Once stasis was reached during the simulation, the particle collisions were analyzed and sorted by peak energy levels. These were normalized to particle mass and mill power to produce comparative energy distribution curves. The peak energy curves were compared in the normal and in sheer directions by particle size.

Figure 12:
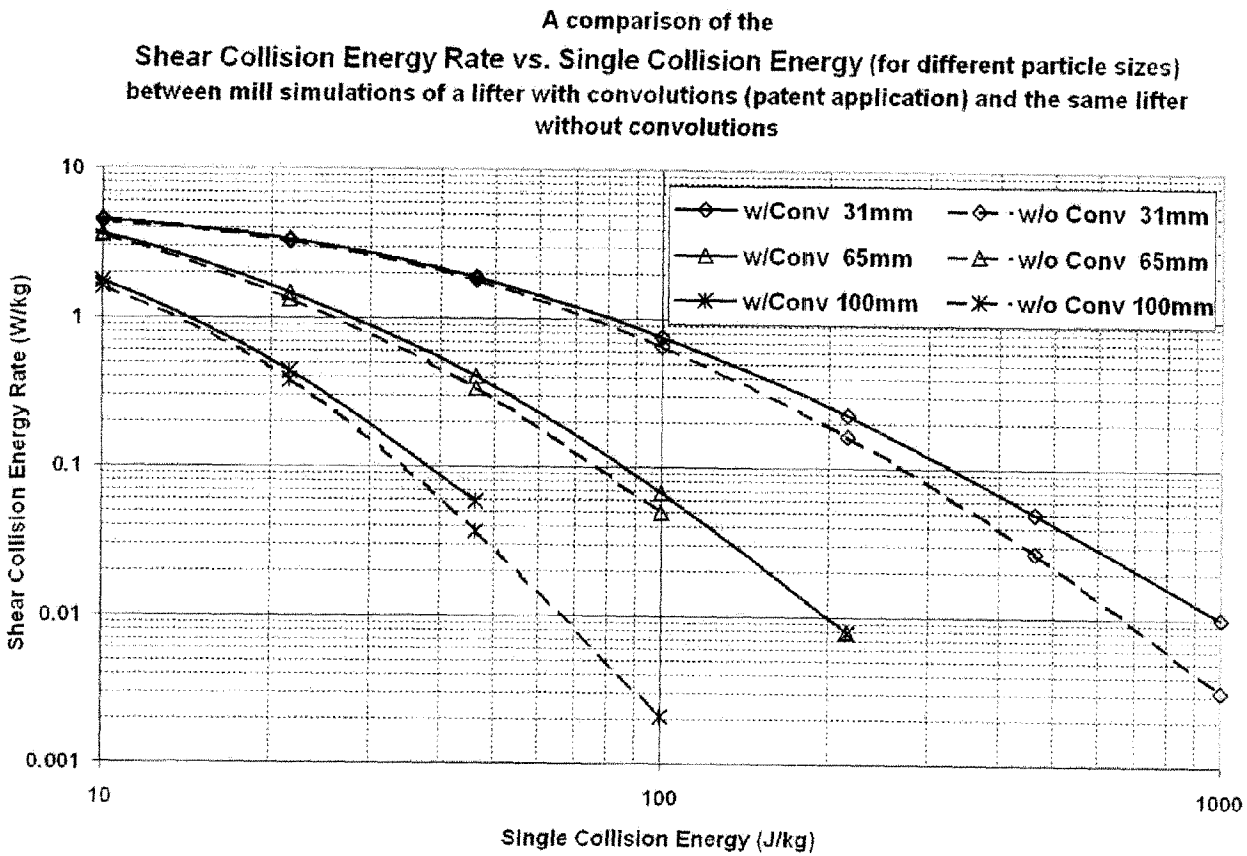
FIG. 12 is a graph illustrating the values produced in a computer analysis of the present invention.

The results of this testing can best be summarized by reference to the graph of FIG. 12. This plotted (on the vertical scale) impact collision frequency against the collision energy (on the horizontal scale). The energy value relates to the strength of the force that is exerted and the distance through which the force is applied. The solid lines represent the performance of the grinding mill using the present invention, and the broken line represents the performance of the related prior art version without the valleys of the present invention. Earlier analysis has illustrated that there is a valid relationship between the energy applied to the rock and the degree to which the rock is broken.

It is believed that these improved results are the effect of the embodiments of the present invention causing the rock to be wedged in a manner so as to remain stationary. Thus, when there is an impact force against a rock held stationary, it would react to the force to a greater degree than if the rock were hit in a more open environment where it could bounce away from the applied force. In the latter instance, the effective force would be less. However, regardless of whether or not this explanation is correct, the present analysis would clearly indicate the improved results provided by the embodiments of the present invention.

It is obvious that various modifications can be made without departing from the basic teachings of the present invention.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A grinding mill comprising:

a) a grinding section comprising a substantially cylindrical structure which defines a grinding chamber and which is mounted to be able to rotate about a longitudinal center axis of said cylindrical structure in a forward direction;

b) a lift section which is positioned within said structure and which comprises a plurality of lift elements which are mounted in said structure and arranged to travel with said structure in a generally circular path in a forward direction;

c) at least some of said lift elements being adjacent lift elements located in side-by-side relationship so as to be located at intervals longitudinally spaced from one another, each of said adjacent lift elements having a contact surface comprising a middle contact surface portion and two oppositely positioned side surface contact portions which at least in part slant from said middle contact surface portion from one another in longitudinal directions in a manner that pairs of said adjacent lift elements have facing pairs of side surface contact portions which face one another and slant downwardly toward one another as pairs of valley surfaces to form a related valley region which has a substantial valley alignment which is aligned in a forward direction generally parallel to the circular forward path of travel of the lift elements;

whereby as rocks and rock fragments tumble from an upper located side of the rotating lift section, the valley surfaces that form the valley region have a channeling effect in directing a path of travel of rocks and rock fragments into valley regions so that there is a wedge action against the facing valley surfaces so as to be capable of introducing sheer forces exerted on wedged rocks as other rocks and rock fragments fall from an upper forward location in the grinding chamber and impact the rocks and rock fragments to exert the sheer forces and cause greater fracturing of the rocks and rock surfaces.

2. A grinding mill according to claim 1 wherein said middle contact surface portion of said some of said lift elements comprises an upper rear contact surface portion having a relatively greater horizontal alignment component, an intermediate contact surface portion having a relatively steeper forwardly slanting alignment component, and a more forward lower contact surface portion having a relatively greater horizontal alignment component.

3. A grinding mill according to claim 1 wherein said oppositely positioned side surface contact portions of said some of said lift elements slant from each other substantially symmetrically relative to a vertical alignment axis of the lift element.

4. A grinding mill according to claim 1 wherein said at least some of said lift elements are positioned in groups adjacent to one another with the lift elements of a single group positioned one in front of another in alignment with the circular path of travel.

5. A grinding mill according to claim 4 wherein said at least some of said lift elements are positioned in generally-longitudinally extending rows that are substantially at a right angle relative to the circular forward path of the travel of the lift elements.

6. A grinding mill according to claim 1 wherein said at least some of said lift elements are positioned in a laterally extending row that is substantially at a right angle relative to a circular forward path of the travel of the lift elements.

7. The grinding mill of claim 1, wherein:

a) said grinding section is mounted to be able to rotate about said longitudinal axis in an opposite direction;

b) said lift section comprises a plurality of additional lift elements, each of which is mounted in said structure and arranged to travel with said structure in a generally circular path in an opposite rearward direction;

c) each of said additional lift elements being positioned adjacent to, and aligned with, a related one of the lift elements of claim 1, but facing in a rearward direction, each of said additional lift elements having a contact surface comprising a middle contact surface portion and two oppositely positioned side surface contact portions which at least in part slant from said middle contact surface portion away from one another in a manner that pairs of said adjacent lift elements have facing pairs of side surface contact portions which face one another and slant toward one another as valley surfaces to form a related valley region.

8. The grinding mill as recited in claim 1, wherein the pairs of valley surfaces of said at least some of said lift elements form an angle between two-thirds of a straight angle of 180° and one-third of a right angle.

9. The grinding mill as recited in claim 1, wherein the pairs of valley surfaces of said at least some of said lift elements are from about a right angle and one-third of a right angle.

10. The grinding mill as recited in claim 1, wherein the pairs of valley surfaces of said at least some of said lift elements are from an angle from about 75° to one-half of 55°.

11. The grinding mill as recited in claim 1, wherein the pairs of valley surfaces of said at least some of said lift elements form an angle of about one-third of a straight 180° angle.

12. The grinding mill of claim 1, wherein said middle contact surface portion of said some of said lift elements comprises an upper rear surface portion, an intermediate downward and forward sloping contact surface portion, and a forward more horizontal upwardly facing surface portion.

13. The grinding mill of claim 12, wherein said rear surface portion has an upper surface ranging from being horizontal to sloping downwardly and forwardly at about 30° from horizontal.

14. The grinding mill of claim 12, wherein said downward and forward sloping contact surface portion slants at an angle between 15° and 60° from horizontal.

15. The grinding mill of claim 12, wherein said forward upwardly facing portion has an alignment which is between a 15° slope downwardly and rearwardly to a 15° slope downwardly and forwardly.

16. The grinding mill of claim 12, wherein:

a) said rear surface portion has an upper surface ranging from being horizontal to sloping downwardly and forwardly at about 30° from horizontal;

b) said downward and forward sloping contact surface portion slants at an angle between 15° and 60° from horizontal;

c) said forward upwardly facing portion has an alignment which is between a 15° slope downwardly and rearwardly to a 15° slope downwardly and forwardly from horizontal.

17. The grinding mill of claim 1, wherein said some of said lift elements further comprise a base and the lift elements with the base comprise a lift element structure, each pair of adjacent lift members having a valley floor between lower valley portions of the pair of adjacent valley surfaces, at least a portion of the lift element structure at said valley floor comprises a portion of lower strength material relative to the strength of adjacent lower side surface contact portions and extending in a direction between said lower valley portions to enable lower edge portions of the lift members to wear away and maintain a more desired configuration.

18. The grinding mill of claim 17, wherein the valley floor comprises two of said portions of lower strength material with an intermediate valley floor portion of the higher strength material located between said two of said portions of lower strength material.

19. The grinding mill of claim 17, wherein the lift element structure comprises a plurality of separate components which are connected with one another, comprising a main central location portion which is at a central portion of the lift element structure and two side sections and a shared juncture section.

20. The grinding mill of claim 18, wherein the lift element structure comprises at least four separate components comprising a main central section at a central location of the lift element, two of said lower strength valley portions and a shared intermediate valley floor portion made of a higher strength material.

* * * * *

UNITED STATES PATENT AND TRADEMARK OFFICE

CERTIFICATE OF CORRECTION

PATENT NO. : 7,497,395 B2
APPLICATION NO. : 11/758628
DATED : March 3, 2009
INVENTOR(S) : Lawrence K. Nordell It is certified that error appears in the above-identified patent and that said Letters Patent is hereby corrected as shown below:

Title Page; item (73); please insert;
-- Assignee: Comminution Technology, JV, 1111 W. Holly St., Bellingham, WA 98225 --

Signed and Sealed this

Twenty-sixth Day of May, 2009

JOHN DOLL
*Acting Director of the United States Patent and Trademark Office*